US007584637B2

(12) United States Patent
Ghiran et al.

(10) Patent No.: US 7,584,637 B2
(45) Date of Patent: Sep. 8, 2009

(54) BENDING APPARATUS AND METHOD OF BENDING A METAL OBJECT

(75) Inventors: Mike M. Ghiran, Lake Orion, MI (US); Spyros P. Mellas, Waterford, MI (US); William M. Crantas, Highland, MI (US); Kevin R. Marks, Durand, MI (US); David R. Friddell, Grand Blanc, MI (US); Paul D. Larsen, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/971,989

(22) Filed: Jan. 10, 2008

(65) Prior Publication Data

US 2009/0178453 A1 Jul. 16, 2009

(51) Int. Cl.
*B21D 7/04* (2006.01)

(52) U.S. Cl. ..... 72/31.05; 72/17.3; 72/31.01; 72/31.1; 72/149; 72/369; 72/702

(58) Field of Classification Search ..... 72/16.1, 72/16.3, 17.1, 17.3, 31.05, 31.01, 31.1, 149, 72/202, 369, 702
See application file for complete search history.

(56) References Cited

U.S. PATENT DOCUMENTS 3,352,136 A * 11/1967 Clarke ..... 72/16.2
4,564,765 A * 1/1986 Blaich ..... 72/389.3
4,947,666 A * 8/1990 Hametner et al. ..... 72/702
5,046,852 A * 9/1991 Hametner et al. ..... 356/398
5,275,031 A * 1/1994 Whiteside et al. ..... 72/17.3
5,305,223 A * 4/1994 Saegusa ..... 72/149
5,497,647 A * 3/1996 Nagakura ..... 72/389.3
5,797,289 A * 8/1998 Hoshino ..... 72/17.3
5,992,210 A * 11/1999 Blurton-Jones ..... 72/702
6,161,408 A * 12/2000 Ooenoki et al. ..... 72/702
6,253,595 B1 * 7/2001 Lewis, Jr. ..... 72/369
6,662,610 B1 * 12/2003 Sekita et al. ..... 72/31.1
6,708,541 B1 * 3/2004 Matsumoto et al. ..... 72/31.1
6,807,835 B1 * 10/2004 Sekita et al. ..... 72/702

* cited by examiner

*Primary Examiner*—David B Jones
(74) *Attorney, Agent, or Firm*—Quinn Law Group, PLLC

(57) ABSTRACT

A method of bending a metal object, such as a tube, is provided that uses real time, closed-loop feedback of the actual springback of the object in order to modify the applied bending force or preprogrammed bending coordinates so that the final desired bend geometry is achieved. The variability of springback from object to object is thus accounted for and the number of objects that must be scrapped due to incorrect bends (over bend or under bend) is reduced. The method is carried out using an apparatus such as a rotary draw bender with a measuring device operable to measure actual bend coordinates of metal objects bent by the bender. A controller is operatively connected to the bender and the measuring device and is configured to control the bender to bend the metal objects at least partly based on measured bend coordinates provided by the measuring device.

9 Claims, 10 Drawing Sheets

BENDING APPARATUS AND METHOD OF BENDING A METAL OBJECT

TECHNICAL FIELD

The invention relates to a method of bending a metal object that provides real time bend verification and correction, and a bending apparatus for same.

BACKGROUND OF THE INVENTION

While bending metal objects, such as metal tubes, many variables are encountered that must be accounted for to ensure that the desired final geometry is achieved. One such variable is the natural variation of sheet metal from coil to coil and its associated springback changes. Other contributors to processing variations include ambient temperature, machine temperature, lubrication, wear and tear of the bend tooling, and tooling setup. Metal tubes are formed from sheet metal rolled into a tubular shape and welded along an axial seam. "Springback" is the tendency of sheet metal (or a metal tube formed from a sheet) to lose some of its shape when it is removed from a die. As the die is released, the work piece ends up with less bend than that on the die (i.e., an "under bend"). The amount of springback is dependent on the characteristics of the material, including thickness, grain and temper. Springback that is not properly predicted or corrected can lead to excessive scrap rates.

SUMMARY OF THE INVENTION

A method of bending a metal object, such as a tube, is provided that uses real time, closed-loop feedback of the actual springback of the object in order to modify the applied bending force or preprogrammed bending coordinates so that the final desired bend geometry is achieved. The variability of springback from object to object is thus accounted for and the number of objects that must be scrapped due to incorrect bends (over bend or under bend) is reduced. The method is carried out using an apparatus that includes a stationary base and a measuring device that is secured to the base. A rotatable bend die, a clamp die secured to the bend die and a pressure die movable with respect to the rotatable base, such as may be present on a rotary draw bender, are configured to bend metal objects and are also included in the apparatus. The pressure die acts on a wiper die. Additionally, a particular bend may require a mandrel to be placed between the wiper die and the metal object. The measuring device is operable to measure actual bend coordinates of metal objects bent by the dies. A controller is operatively connected to the dies, the base, and the measuring device and is configured to control the dies to bend the metal objects at least partly based on measured bend coordinates (i.e., feedback of actual springback) provided by the measuring device.

The method includes applying force to bend a first portion of a first metal object (such as a tube) a first time to a first predetermined bend coordinate. The first predetermined bend coordinate is based at least in part on expected springback (i.e., springback based on characteristics of the metal, but that has not been verified as actual springback of the particular metal tube). The force is then released, and the tube is allowed to springback. An actual bend coordinate is then measured after the springback. This measurement may be via a video camera. The controller then determines whether the tube is over bent, in which case it is scrapped, or under bent, in which case a first bend correction factor is calculated based on the first predetermined bend coordinate and the first actual (i.e., measured) bend coordinate. (If the tube is neither over nor under bent, then a predetermined bend coordinate, based on expected springback, is used for a subsequent bend without a bend correction factor being necessary.) If the tube was under bent, force is then reapplied via the dies to bend the first portion of the first metal object a second time (i.e., the first portion is rebent) based at least in part on the calculated first bend correction factor. When the force is released, the tube springback should result in the tube being at the desired bend coordinates and having the desired tube geometry. If subsequent bends in the same tube are desired, force may be applied to bend a second portion of the tube based on the calculated first bend correction factor (i.e., using the measured actual springback to obtain a more precise bend when the force is released). If a second metal object such as a second metal tube is to be bent to achieve the same desired bend coordinates as the first metal object, the controller "resets" in that it reverts to bending the second metal object to the predetermined bend coordinate based on expected springback. This allows the actual springback of the second metal object to be individually determined by measuring the actual bend coordinate of the second metal object after releasing the second metal object. A second bend correction factor is then calculated based on the predetermined coordinate and the second actual bend coordinate. Force is then reapplied to bend the first portion of the second object a second time (i.e., the second tube is rebent) to a second revised bend coordinate based at least in part on the second calculated bend correction factor. When the reapplied force is released, the second tube should springback to the desired coordinate.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 2:
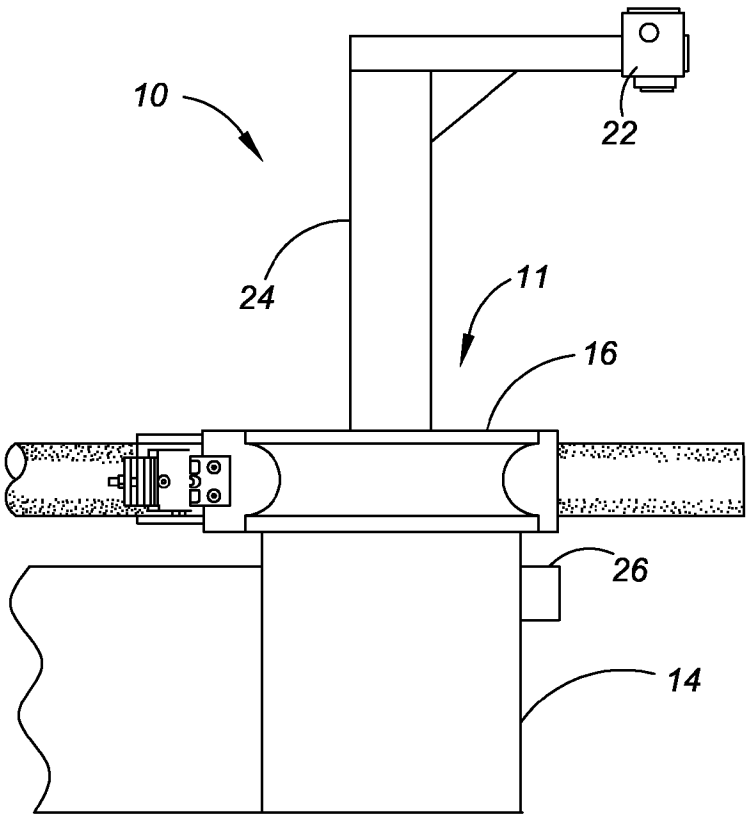
FIG. 2 is a schematic illustration in side view of the rotary draw bender of FIG. 1.
Figure 1:
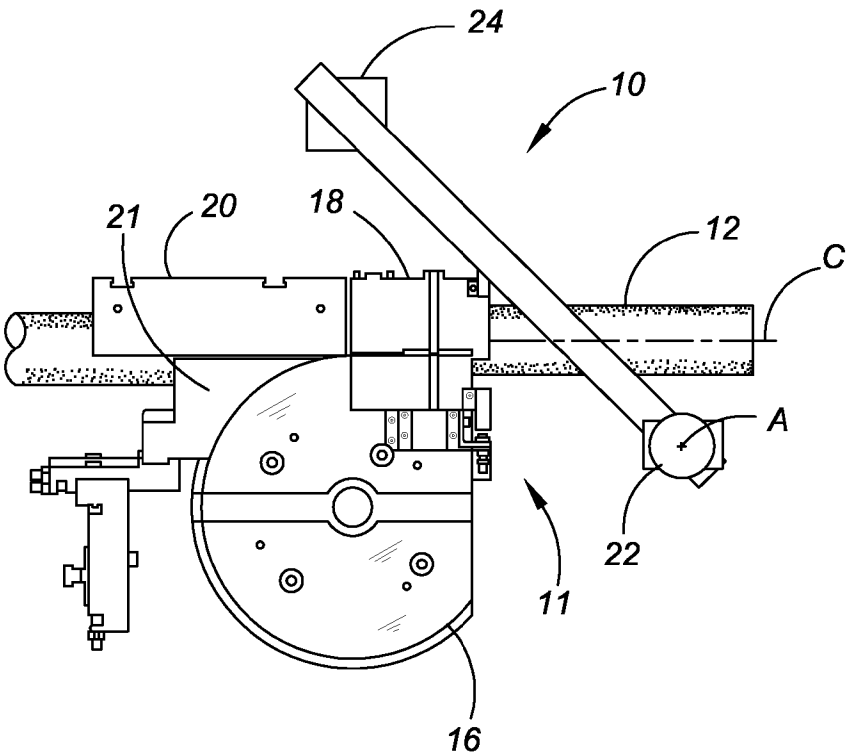
FIG. 1 is a schematic illustration in plan view of a rotary draw bender with a clamp die clamping an unbent metal tube.

Referring to the drawings, wherein like reference numbers refer to like components, FIG. 1 shows an apparatus 10 for bending objects that includes a rotary draw bender 11 shown with a bendable object in the form of a metal tube 12. As can be seen in FIG. 2, the rotary draw bender 11 includes a stationary base 14 that supports a rotatable bend die 16. Bending is accomplished by clamping the tube 12 with a clamp die 18 against the bend die 16 and the pressure die 20 against a wiper die 21. The bend die 16 and the clamp die 18 are rotated as a unit starting plastic deformation of a first bend 30 in tube 12 (see FIG. 3). The pressure die 20 is delayed to prevent it from colliding with the clamp die 18 and to allow for material elongation on the inner side (compression side) of the bend as it flows against the wiper die 21 to prevent wrinkling. The apparatus 10 also includes a measuring device, optionally in the form of a video camera 22, positioned on a stationary support post 24 above the metal tube 12.

The apparatus 10 further includes a controller 26 that is operatively connected by electrical wires (not shown), radio frequency, wireless connections, or otherwise, to the clamp die 18, pressure die 20 and bend die 16, as well as to the video camera 22. The video camera 22 records an image of the tube 12 and relays the position of the tube 12 derived from the image to the controller 26.

An algorithm is stored within the controller 26 that is configured to provide feedback on springback of the metal tube 12 to verify and correct bends applied by the bender 11 to ensure that the intended bend coordinates are achieved. The algorithm is described below with respect to FIGS. 12A-12B and 13 as a series of steps carried out by the apparatus 10 under the control of controller 26. The algorithm may carry out a method of bending metal objects 100 illustrated in FIGS. 12A and 12B as a series of steps carried out by the apparatus 10 under the control of controller 26. Similarly, the algorithm may carry out a method of manufacturing bent metal tubes 200 illustrated in FIG. 13 as a series of steps carried out by the apparatus 10 under the control of the controller 26.

Figure 4:
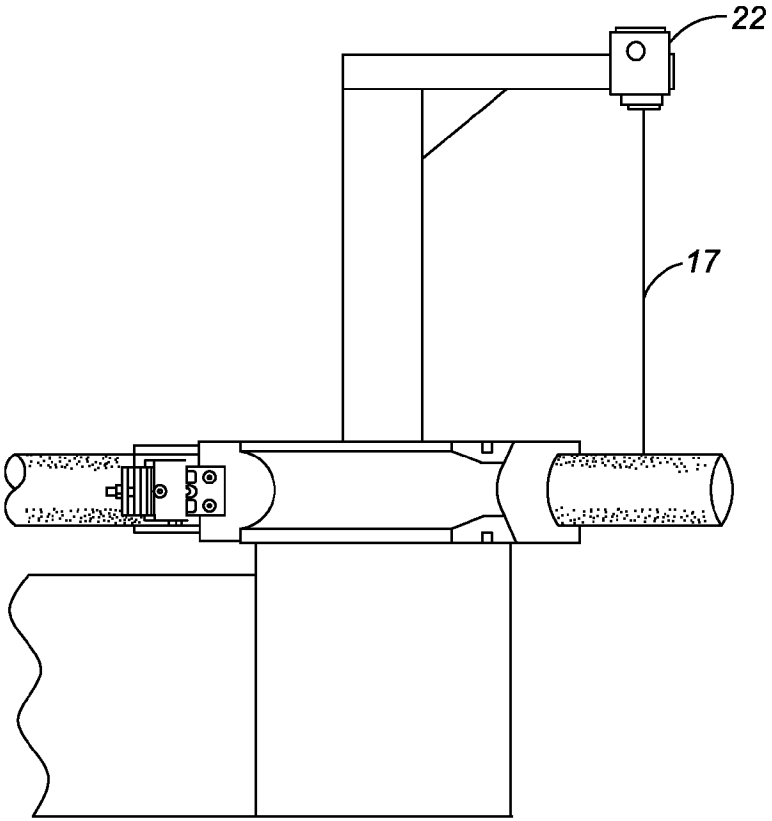
FIG. 4 is a schematic illustration in side view of the rotary draw bender and bent tube of FIG. 3.
Figure 3:
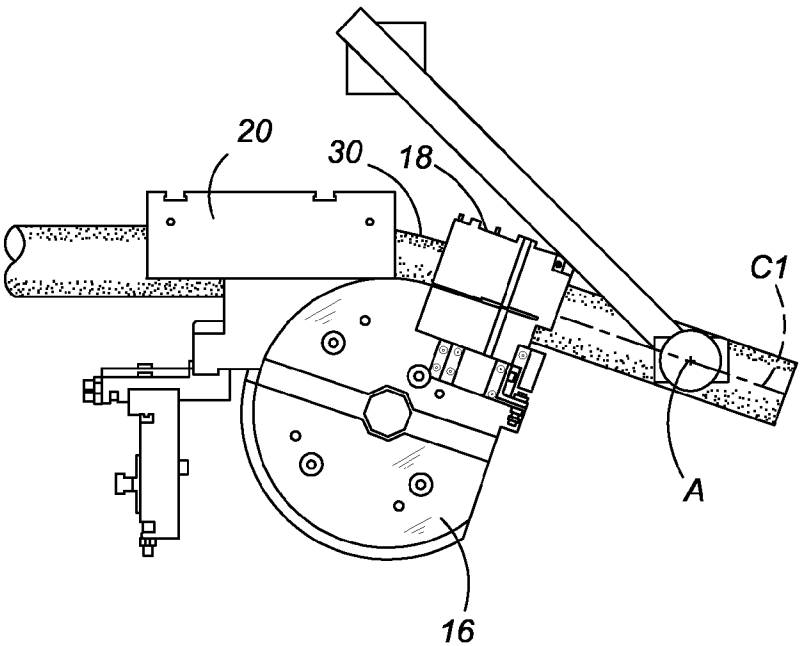
FIG. 3 is a schematic illustration in plan view of the rotary draw bender of FIGS. 1 and 2 with the clamp die closed and a pressure die applied to bend a first portion of the metal tube to a predetermined bend coordinate.
Figure 11:
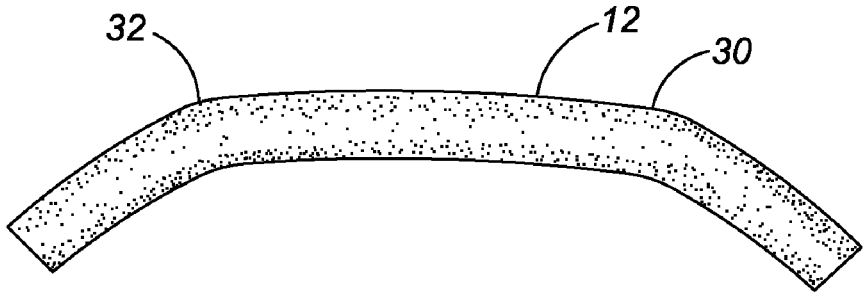
FIG. 11 is a schematic illustration in side view of the bent metal tube of FIGS. 1-10 with the bends at the first and second portions.
Figure 12A:
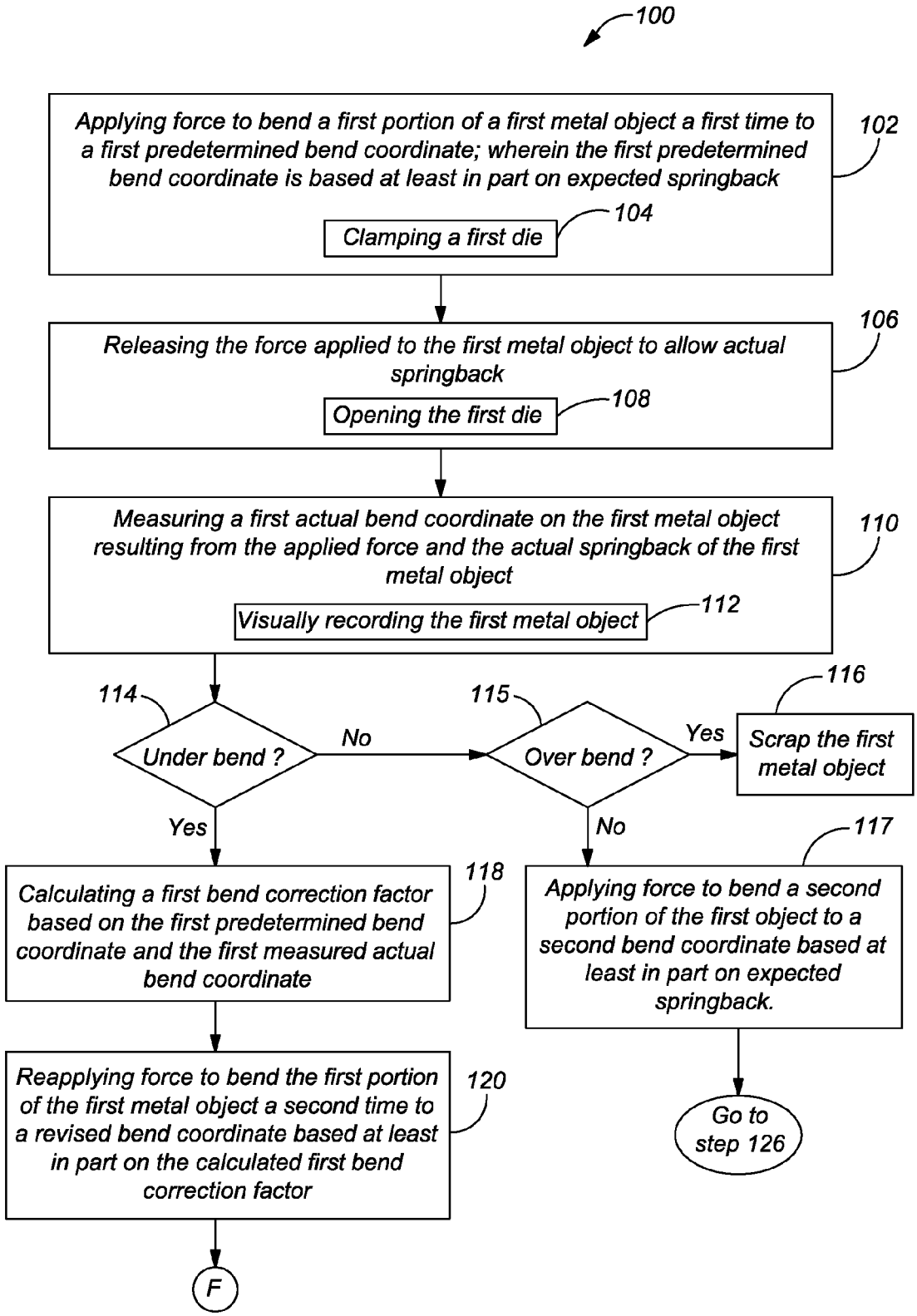
FIGS. 12A and 12B are a flow diagram illustrating a method of bending metal tubes.
Figure 12B:
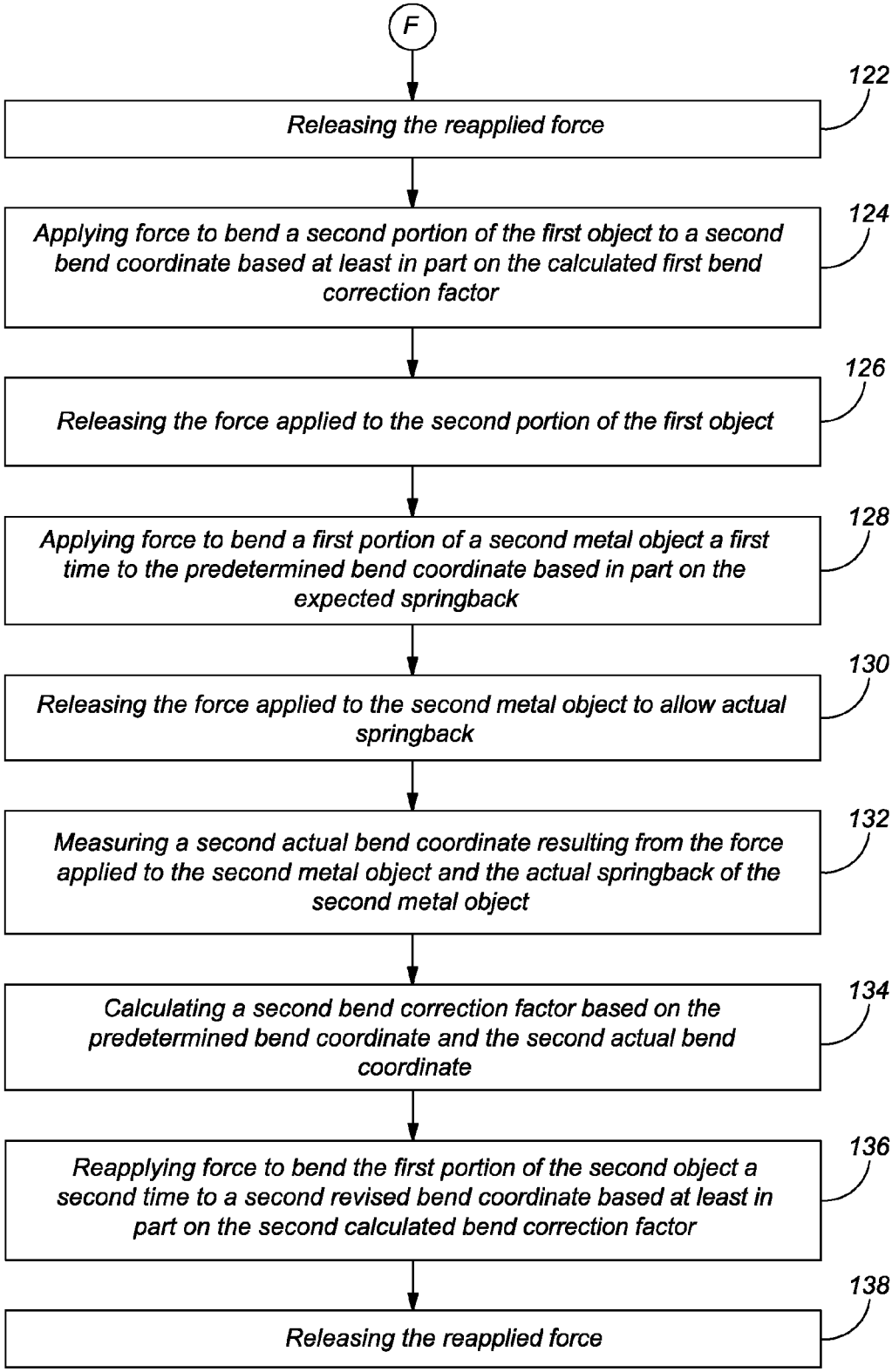

Referring to FIGS. 12A and 12B, the method 100 will be described with respect to the apparatus 10 shown in FIGS. 1-10 and the product of the apparatus, a bent tube 12 forming an automotive frame component such as a roll bar, shown in FIG. 11. The method 100 is illustrated in both FIGS. 12A and 12B, with the flow diagram if FIG. 12A continuing in FIG. 12B at bullet F. The method 100 includes step 102, applying force to bend a first portion of a first metal object a first time to a first predetermined bend coordinate; wherein the first predetermined bend coordinate is based at least in part on expected springback. Step 102 includes step 104, clamping a first die (i.e., the clamp die 18). Steps 102 and 104 are illustrated in FIGS. 3 and 4. The clamp die 18 is closed and the pressure die 20 moves forward, applying force to the tube 12 as the bend die 16 rotates a predetermined amount to bend a first portion 30 of the tube 12. The dies 16, 18, 20 are controlled such that the tube 12 is bent to a first predetermined coordinate stored in the controller 26, which here is represented as a point A, centered under the video camera 22, with the tube 12 bent until a centerline C1 of the tube 12 is aligned with the point A. Because it is understood that all ductile metals will possess some degree of springback, the first predetermined coordinate A is determined specifically taking into account the minimum springback for the given material being bent. As will be seen in the explanation below this will allow some tubes to flow through the bending apparatus 10 without the need for further corrections and reduce any impacts on cycle time. During the bending operation of step 102, the camera 22 is active and records the position of the tube 12 at the end of the desired (first) bend. The data is sent to the controller 26 to determine the position of the tube 12 and the degree of bend. The recording of data is indicated in FIG. 4 by view line 17 of the camera 22.

Figure 5:
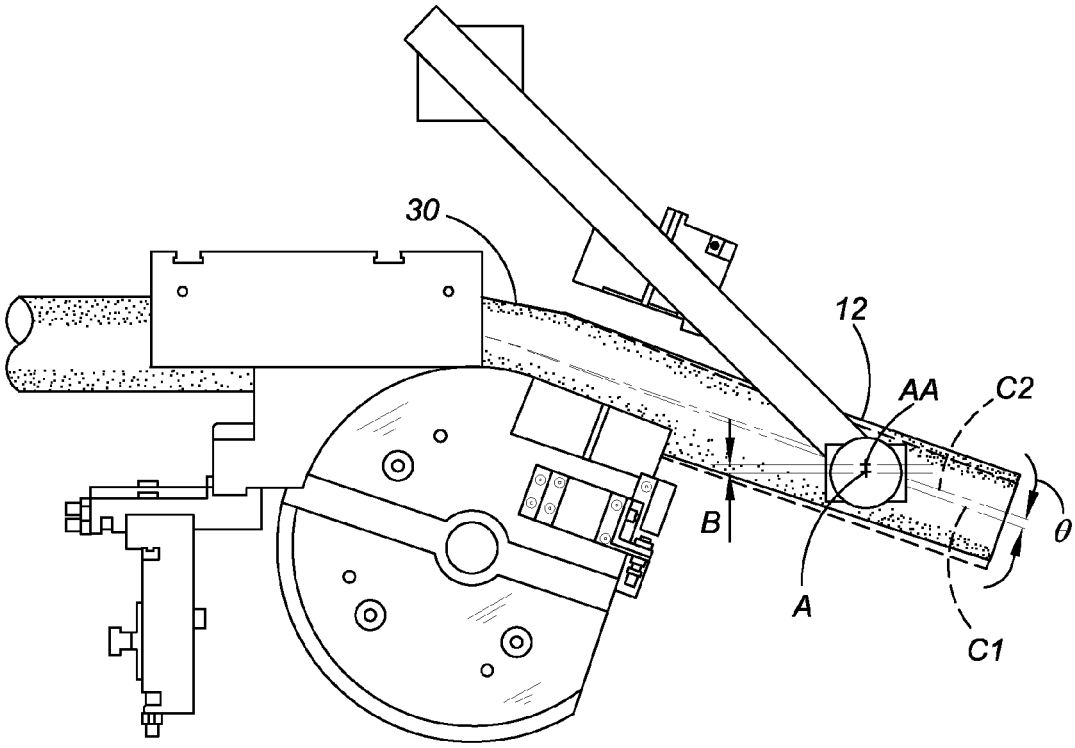
FIG. 5 is a schematic illustration in plan view of the rotary draw bender and metal tube of FIGS. 1-4 with the clamp die released and the metal tube having sprung back from the predetermined bend coordinate.

Referring again to FIGS. 1 through 4, following steps 102 and 104, step 106 is carried out, releasing the force applied to the first metal object to allow actual springback. Step 106 includes step 108, opening the first die (i.e., the clamp die 18). Thus, under step 106, the clamp die 18 is opened, freeing the tube 12 to undergo an actual amount of springback, as illustrated in FIG. 5 as the centerline of the tube 12 shifts slightly away from the predetermined point A to a position in which the centerline is referred to as C2. (The position of the centerline C1 prior to release of the dies is shown in phantom on FIG. 5 to illustrate the amount of springback.) The method 100 includes step 110, measuring a first actual bend coordinate on the first metal object resulting from the applied force and the actual springback of the first metal object. Step 110 may include step 112, visually recording the first metal object, such as by using the camera 22 again to record the position of the tube 12 after the actual springback, and sending this data back to the controller 26. The data on the position of the tube 12 recorded by the camera 22 after step 102 and again after step 106 may be an angle (e.g., the angle of the centerline C2 relative to a predetermined line, such as the centerline when at the predetermined position C1, with the angle represented as θ), a distance (e.g., the distance B of the centerline C2 from point A along a radius extending from point A), or any other data relating the relative positions. For purposes of this description, it will be assumed that the first actual bend coordinate measured by the camera 22 is the position of the centerline C2. Based on step 110, the controller 26 can determine in step 114 whether the actual bend coordinate is indicative of an under bend or, in step 115, an over bend by comparing the actual springback amount to the predetermined springback amount. In the case of an over bend (i.e., where the actual springback was less than that anticipated), the tube 2 is scrapped under step 116. The occurrence of an over bend will alert the operator to an unexpected material condition that should warrant further investigation. Possible causes could include inadvertently using tubes of a different material, using tube material that is out of specification, or a need to revise the predetermined (minimum) springback setting. If neither an over bend nor under bend exists (i.e., the first actual bend coordinate is the same as the first predetermined bend coordinate), then the first bend is complete and the method 100 moves to step 117, with force applied to bend a second portion of the first object to a second bend coordinate based at least in part on expected springback. The method then moves to step 126, described below.

In the case of an under bend determined under step 114, then, under step 118, the controller 26 calculates a first bend correction factor based on the difference between the actual springback and the expected springback. The actual springback is the difference between the first predetermined bend coordinate (e.g., A) and the first measured actual bend coordinate C2. In this embodiment, the actual springback is the distance between the position of centerline C2 after actual springback and the predetermined coordinate A, e.g., the distance B along a radial line extending through the predetermined coordinate A. Because the expected amount of springback is already stored in the controller 26 and represents some percentage of distance B, the first bend correction factor is the portion of distance B that is unexpected (i.e., that represents excessive springback above and beyond that expected of the particular material). Based on the data measured in step 110, if the actual springback of tube 12 is consistent with the expected springback, no corrections are needed, as the bend of the tube 12 at the first portion 30 is consistent with the desired parameters. However if the bent tube 12 is under bent (due to higher spring back) then the controller 26 corrects the stored bend data used to control movement of the dies 16, 18, 20 with a springback correction factor. The bend at the first portion 30 is corrected under step 120 in which force is reapplied via the dies 16, 18, 20 to bend the first portion 30 of the first tube 12 a second time to a revised bend coordinate based at least in part on the calculated first bend correction factor. That is, referring to FIG. 6, the clamp die 18 is closed and the pressure die 20 and bender die 16 are controlled to bend the tube 12 the incremental amount that the tube 12 is under bent plus a newly determined springback amount, as illustrated by moving the tube 12 until the centerline is in a position referred to as C3, past point A. Next, under step 122, the reapplied force is released, and the tube 12 undergoes springback to the desired position, as illustrated in FIG. 7 wherein the centerline is in the desired position and is referred to as C4.

Figure 8:
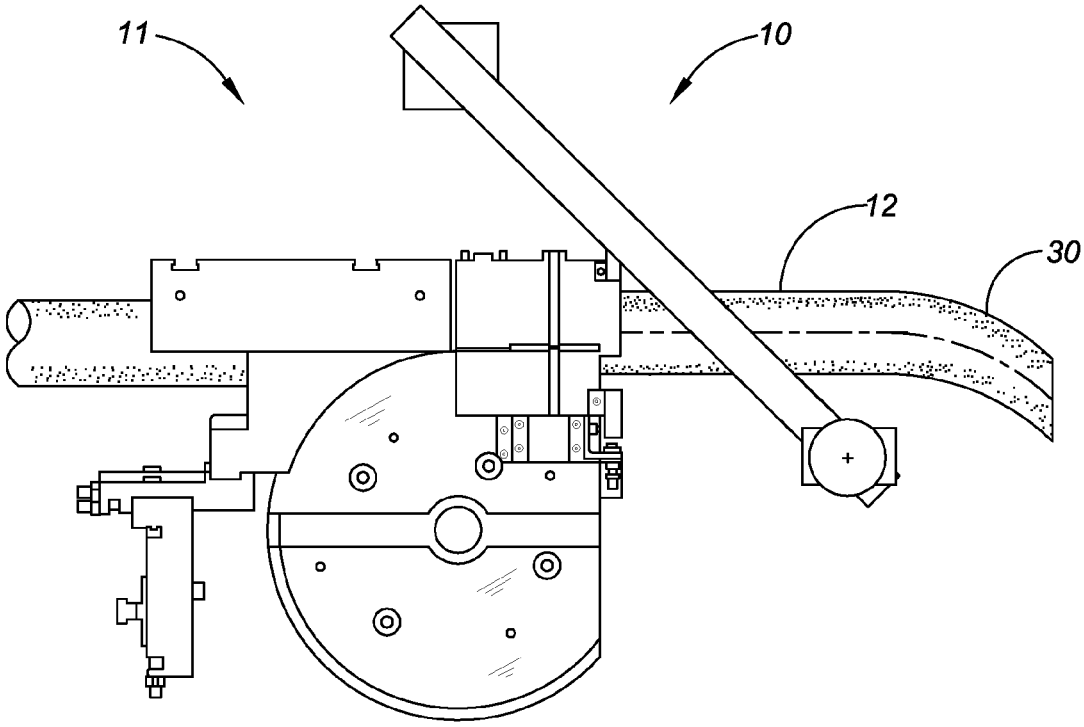
FIG. 8 is a schematic illustration in plan view of the rotary draw bender of FIGS. 1-7 with the metal tube repositioned and the clamp die clamping the metal tube.
Figure 9:
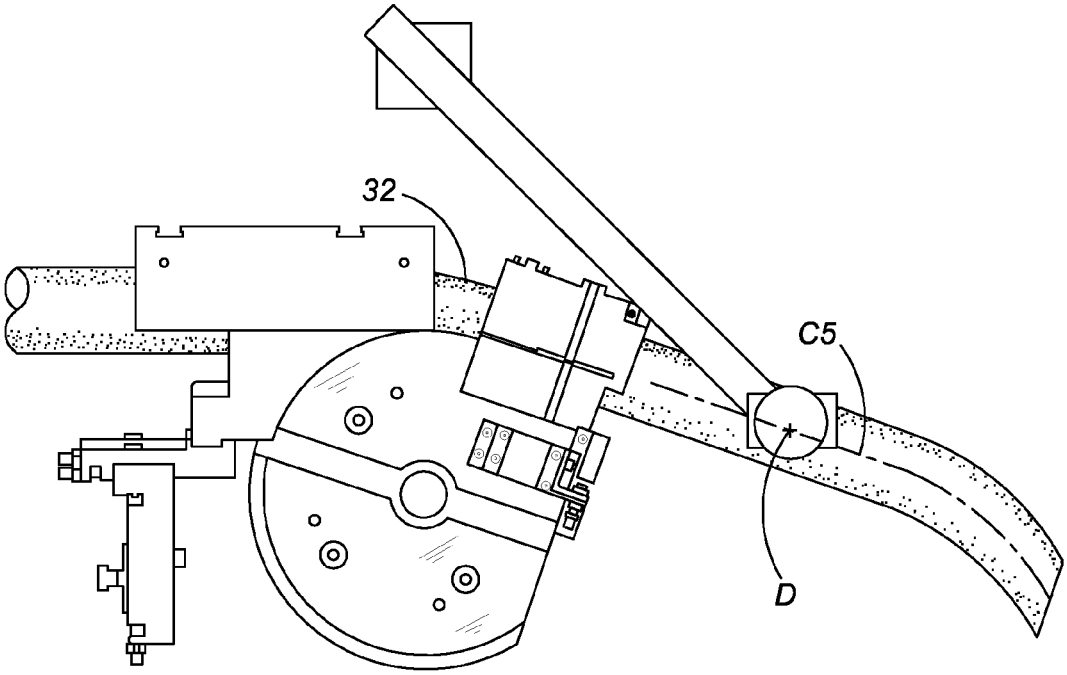
FIG. 9 is a schematic illustration in plan view of the rotary draw bender of FIGS. 1-8 with the clamp die closed and the pressure die applied to bend a second portion of the metal tube to another predetermined bend coordinate.
Figure 10:
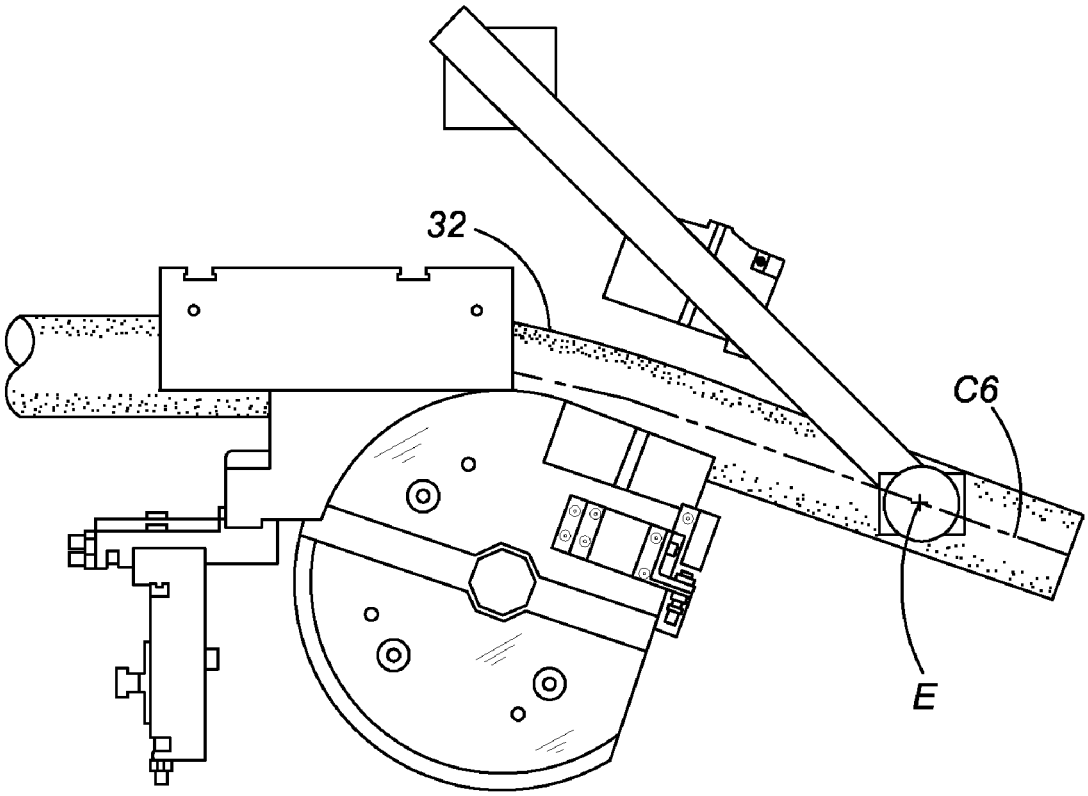
FIG. 10 is a schematic illustration in plan view of the rotary draw bender and metal tube of FIGS. 1-9 with the clamp die released and the metal tube sprung back from the other predetermined bend coordinate to a desired bend coordinate.

With the actual springback of the tube 12 now having been quantified, and the controller 26 having calculated the first bend correction factor to modify the preprogrammed bend coordinates that were based on the expected springback, all subsequent bends on tube 12 may now be bent more precisely as the controller 26 revises all of the predetermined bend coordinates for those subsequent bends using the actual measured springback. Thus, in order to bend a second portion of the tube 12, the tube 12 is repositioned in the bender 11, as illustrated in FIG. 8, and then, in step 124, force is applied with the bend die 16, the clamp die 18, and the pressure die 20 to bend the second portion 20 to a second bend coordinate which here is represented as a point D, centered under the video camera 22, with the tube 12 bent until a centerline C5 of the tube 12 is aligned with the point D. Then, in step 126, the applied force is released, and the tube 12 will springback to the desired bend location, shown in FIG. 10 for purposes of illustration as being when a centerline of the tube 12 is in a position referred to as C6 in which it intersects point E. No corrections (i.e., no "rebends") will be required to the second portion 32, as the bend of the second portion 32 was controlled based on the actual measured springback of the tube 12. As shown in FIG. 11, as a result of the method 100, the tube 12 now has proper bends at bend locations 30 and 32, as desired.

If additional tubes are to be produced to the bend specifications shown in FIG. 11, the actual springback of each tube is separately determined in order to account for any variations. For example, if a second tube is placed in the bender 11, under step 128, force is applied to bend a first portion of the second tube a first time to a first predetermined bend coordinate based in part on the same expected springback that was initially used in forming the first bend 30 of the first tube 12. This will be well understood by those skilled in the art by viewing FIG. 3 and assuming that the tube 12 is a second tube. Next, as in step 106 with the first tube, in step 130, force is released to allow the second tube to springback, as represented with respect to the first tube in FIG. 5. The amount of springback occurring with the second tube may very well be different than the amount that occurred with the first tube 12. A second actual bend coordinate of the second tube is measured in step 132, and then a second bend correction factor is calculated in step 134 based on the actual measured springback of the second tube (i.e., the difference between the predetermined bend coordinate and the second actual bend coordinate). Force is then reapplied in step 136 to bend the first portion of the second tube a second time to a second revised bend coordinate that takes into account the second calculated bend correction factor. Finally, in step 138, the force is released, and the second tube should springback an amount such that the first bend has the desired geometry. As the actual springback of the second tube is now quantified, any subsequent bends to the second tube may use the known actual springback and be based on revised bend coordinates. The method 100 should result in fewer scrapped metal tubes (e.g., scrapped due to over bends), as the assumed springback of each tube is separately verified, and corrected, if necessary, using a calculated springback correction factor.

Figure 6:
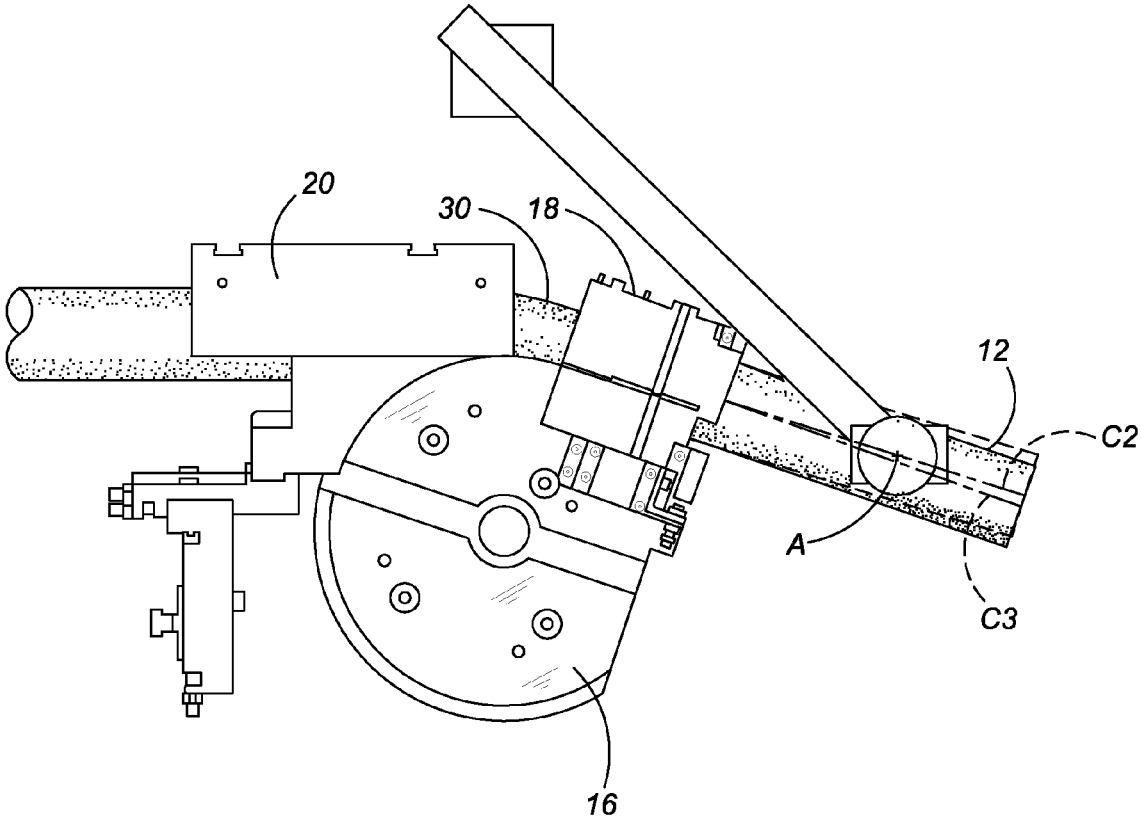
FIG. 6 is a schematic illustration in plan view of the rotary draw bender and metal tube of FIGS. 1-5 with the clamp die closed and the pressure die applied to bend the metal tube beyond the predetermined bend coordinate to correct an under bend.
Figure 7:
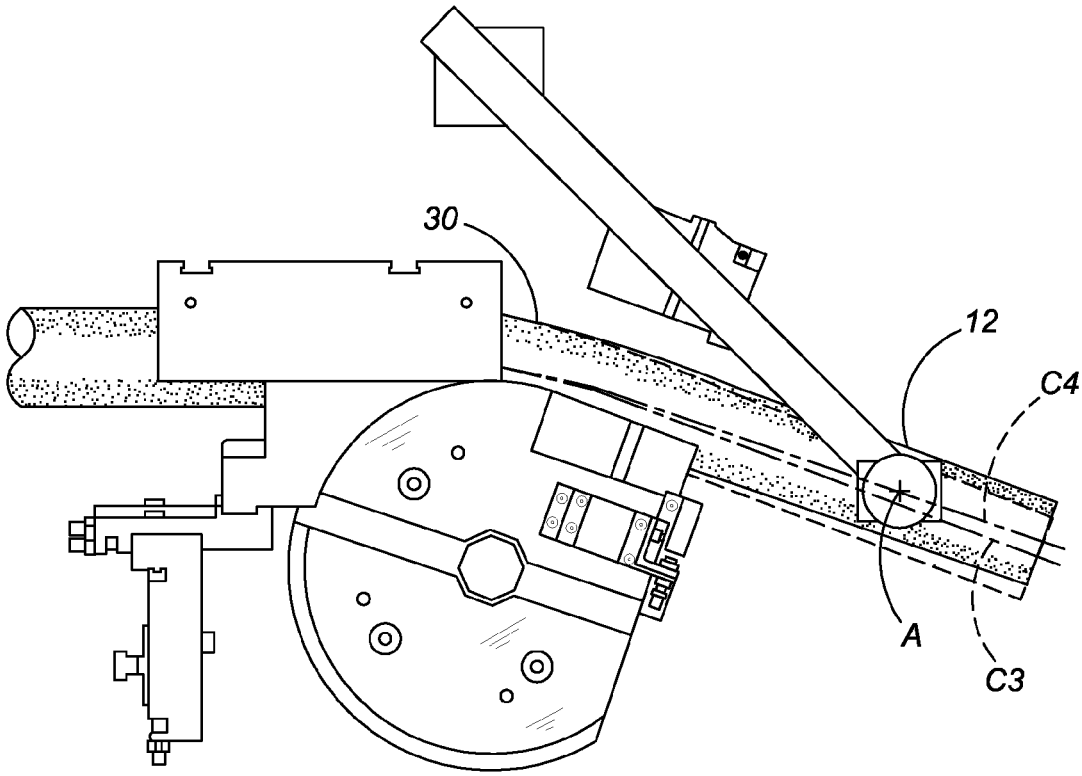
FIG. 7 is a schematic illustration in plan view of the rotary draw bender and metal tube of FIGS. 1-6 with the clamp die released and the metal tube sprung back to a desired bend coordinate.
Figure 13:
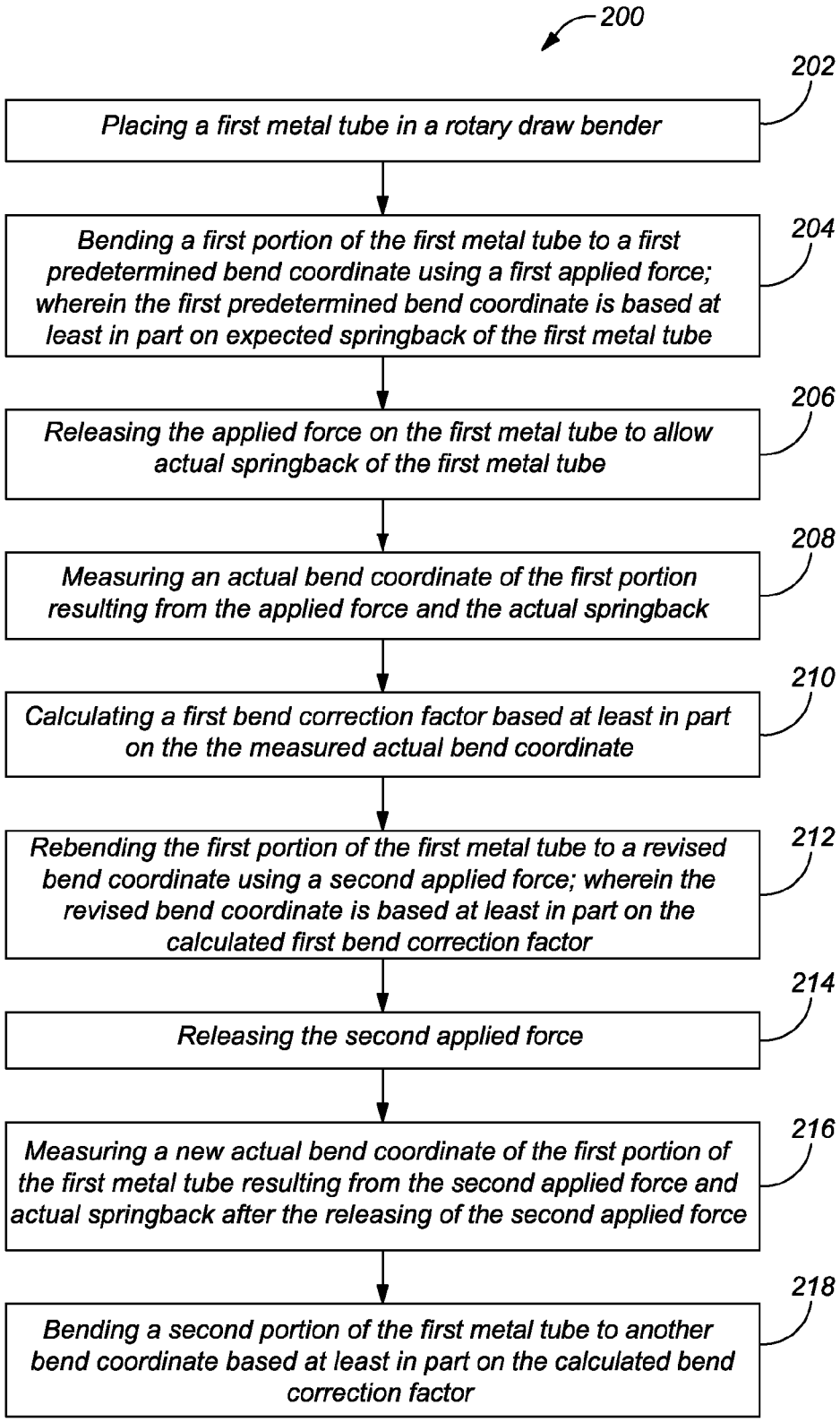
FIG. 13 is a flow diagram illustrating another method of bending metal tubes.

Referring now to FIG. 13, a method of manufacturing bent metal tubes 200 is described with respect to FIGS. 1-12. The method includes step 202, placing a first metal tube 12 in a rotary draw bender 11. Next, in step 204, a first portion 30 of the first metal tube 12 is bent to a first predetermined bend coordinate (e.g., where centerline C1 of the tube 12 is aligned with the predetermined bend coordinate, point A, which is based at least in part on the expected springback of tube 12). Then, in step 206, the force applied in step 204 is released (by releasing clamp die 18), allowing springback of metal tube 12 as in FIG. 5. After the springback, in step 208, an actual bend coordinate of the first bent portion 30 of the metal tube 12 is measured. This may include visually recording the first metal tube 12 with the camera 22 and sending this data back to the controller 26. The data recorded may be an angle (e.g., the angle of the centerline C2 relative to a predetermined line, such as the centerline when at the predetermined position C1, with the angle represented as θ), a distance (e.g., the distance B of the centerline C2 from point A along a radius extending from point A), or any other data relating the relative positions. For purposes of this description, it will be assumed that the first actual bend coordinate measured by the camera 22 is the position of the centerline C2. Under step 210, the controller 26 may then calculate a first bend correction factor based on the actual springback (i.e., the difference between the measured bend coordinate and the predetermined bend coordinate) and its relation to the predetermined springback. Using the first bend correction factor, under step 212, the first portion 30 of the first tube 12 is rebent with a second applied force (i.e., force applied by the dies 16, 18, 20, 21), as shown in FIG. 6, to a revised bend coordinate (represented by the location of the centerline C3) that is based on the first bend correction factor. The force is then released in step 214. In step 216, the accuracy of the bend can now be verified by measuring a new actual bend coordinate, such as the position of the centerline C4 shown in FIG. 7, after step 214. With the accuracy verified, a second portion 32 of the metal tube 12 is then bent to another bend coordinate C5 (as in FIG. 9) that is based at least in part on the bend correction factor. When the tube is released, the second portion 32 should springback to a desired position in which the centerline is at the desired position without requiring a rebend, as the actual springback is now incorporated in the bend coordinates achieved via the dies 16, 18, 20, 21 under the control of the controller 26.

It should be noted that a minimal amount of cycle time may be added to the bending process under method 100 or 200, but the overall uptime, elimination of scrap and quality improvement will more then offset this minimal cycle time increase. Therefore, this invention will reduce if not eliminate scrapped objects due to metal spring back issues in horizontal rotary draw benders and improve overall quality and bender uptime.

While the best modes for carrying out the invention have been described in detail, those familiar with the art to which this invention relates will recognize various alternative designs and embodiments for practicing the invention within the scope of the appended claims.

The invention claimed is:

1. A method of bending a metal object comprising:

applying force with a rotary draw bender to bend a first portion of a first metal object a first time to a predetermined bend coordinate; wherein the predetermined bend coordinate is based at least in part on expected springback of the first metal object to a final bend position; wherein the first metal object is a tube;

releasing the force applied to the first metal object to allow actual springback;

after said releasing, without moving the first metal object relative to the rotary draw bender except movement due to the actual springback, measuring a first actual bend coordinate on the first metal object resulting from the applied force and the actual springback;

calculating a first bend correction factor based on the predetermined bend coordinate and the first measured actual bend coordinate;

reapplying force to bend the first portion of the first metal object a second time to a first revised bend coordinate based at least in part on the calculated first bend correction factor;

releasing the reapplied force from the first portion of the first metal object;

applying force to bend a first portion of a second metal object a first time to the predetermined bend coordinate based in part on the expected springback;

releasing the force applied to the second metal object to allow actual springback of the second metal object;

after said releasing the force applied to the second metal object, measuring a second actual bend coordinate resulting from the force applied to the second metal object and the actual springback of the second metal object;

calculating a second bend correction factor based on the predetermined bend coordinate and the second actual bend coordinate;

reapplying force to bend the first portion of the second metal object a second time to a second revised bend coordinate based at least in part on the second calculated bend correction factor; and releasing the reapplied force from the first portion of the second metal object.

2. The method of claim 1, further comprising:

after said releasing the reapplied force from the first portion of the first metal object, applying force to bend a second portion of the first metal object to a second bend coordinate based at least in part on the calculated first bend correction factor.

3. The method of claim 1, further comprising:

prior to said reapplying force to bend the first portion of the first metal object, determining whether the first actual bend coordinate is indicative of an over bend; and further comprising:

scrapping the first metal object in lieu of reapplying force to bend the first portion if the first actual bend coordinate is indicative of an over bend.

4. The method of claim 1, wherein said measuring a first actual bend coordinate includes visually recording the first metal object with a measurement device secured to the rotary draw bender.

5. The method of claim 1, wherein said applying force is by clamping a first die; and wherein said releasing force is by opening the first die.

6. A method of manufacturing bent metal tubes comprising:

placing a first metal tube in a rotary draw bender;

bending a first portion of the first metal tube to a first predetermined bend coordinate using a first applied force; wherein the first predetermined bend coordinate is based at least in part on expected springback of the first metal tube to a final bend position of the first portion;

releasing the first applied force on the first metal tube to allow actual springback thereof;

after said releasing, without moving the first metal tube relative to the rotary draw bender except movement due to the actual springback, measuring an actual bend coordinate of the first portion resulting from the first applied force and actual springback of the first metal tube;

calculating a bend correction factor based at least in part on the measured actual bend coordinate;

rebending the first portion of the first metal tube to a revised bend coordinate using a second applied force; wherein the revised bend coordinate is based at least in part on the calculated bend correction factor;

releasing the second applied force to allow actual springback of the first metal tube again;

after said releasing the second applied force, measuring a new actual bend coordinate of the first portion resulting from the second applied force and actual springback of the first metal tube after the releasing of the second applied force; and bending a second portion of the first metal tube to another bend coordinate based at least in part on the calculated bend correction factor.

7. The method of claim 6, further comprising:

removing the first metal tube from the rotary draw bender;

placing a second metal tube in the rotary draw bender;

bending a first portion of the second metal tube a first time to the first predetermined bend coordinate using a third applied force; wherein the first predetermined bend coordinate is based at least in part on the expected springback of the second metal tube;

releasing the third applied force to allow actual springback of the second metal tube;

after said releasing the third applied force, measuring a second actual bend coordinate resulting from the third applied force applied to the second metal tube and the actual springback of the second metal tube;

calculating a second bend correction factor based at least in part on the measured second actual bend coordinate;

rebending the first portion of the second metal tube to another revised bend coordinate using a fourth applied force; wherein said another revised bend coordinate is based at least in part on the calculated second bend correction factor;

releasing the fourth applied force;

measuring the new actual bend coordinate of the first portion of the second metal tube resulting from the fourth applied force and actual springback of the second metal tube after releasing the fourth applied force; and bending a second portion of the first metal tube to another bend coordinate based at least in part on the calculated second bend correction factor.

8. An apparatus for bending metal objects, comprising:

a stationary base;

a measuring device secured to the stationary base;

a plurality of dies configured to bend metal objects including a rotatable bend die, and a clamp die rigidly securable to the rotatable bend die, and a pressure die movable with respect to the rotatable bend die;

wherein the measuring device is operable to measure actual bend coordinates of metal objects bent by the dies without movement of the measuring device relative to the stationary base and without post-bending movement of the metal objects relative to the rotary draw bender except movement due to springback; and a controller operatively connected to the dies, the base and the measuring device and configured to control the dies to bend the metal objects at least partly based on the measured bend coordinates provided by the measuring device.

9. The apparatus of claim 8, wherein the measuring device is a camera.

* * * * *